United States Patent [19]

Goffe

[11] 3,960,555

[45] * June 1, 1976

[54] PHOTOGRAPHIC CHARGING AND IMAGING PROCESS

[75] Inventor: William L. Goffe, Webster, N.Y.

[73] Assignee: Xerox Corporation, Stamford, Conn.

[ * ] Notice: The portion of the term of this patent subsequent to July 14, 1987, has been disclaimed.

[22] Filed: Apr. 3, 1967

[21] Appl. No.: 628,029

Related U.S. Application Data

[63] Continuation-in-part of Ser. No. 460,377, June 1, 1965, Pat. No. 3,908,177, which is a continuation-in-part of Ser. No. 403,002, Oct. 12, 1964, abandoned.

[52] U.S. Cl. ..... 96/1 PS; 96/1.5

[51] Int. Cl.[2] ..... G03G 5/04

[58] Field of Search..... 96/1, 1.3, 1 R, 1.1, 96/1.5, 1.8, 1 PS; 117/37 LX; 204/181

[56] References Cited

UNITED STATES PATENTS

| | | | |
|---|---|---|---|
| 2,297,691 | 10/1942 | Carlson | 96/1 |
| 2,885,556 | 5/1959 | Gundlach | 96/1 X |
| 2,990,279 | 6/1961 | Crumley et al. | 96/1.8 |
| 3,121,006 | 2/1964 | Middleton et al. | 96/1.5 |
| 3,238,041 | 3/1966 | Corrsin | 96/1.1 |
| 3,276,031 | 9/1966 | Gaynor | 96/1.1 |
| 3,384,565 | 5/1968 | Tulagin et al. | 96/1 R |

*Primary Examiner*—William A. Powell
*Assistant Examiner*—Brian J. Leitten

[57] ABSTRACT

Charging and imaging methods including providing an imaging member having a dielectric substrate, an overlayer of softenable material and a fracturable layer of particulate material, charging said member either by placing said member with the dielectric substrate contacting an electrical ground and electrically charging the opposite side thereof, or by charging each side of said member to a different polarity. Such an imaging member is imaged by forming an electrostatic latent image on said member, and developing said member whereby selective portions of the particulate material migrate in imagewise configuration toward the dielectric substrate.

17 Claims, 5 Drawing Figures

INVENTOR.
WILLIAM L. GOFFE
BY Owen D Marjama
James J Rabatsle
ATTORNEYS

PHOTOGRAPHIC CHARGING AND IMAGING PROCESS

This application is a continuation-in-part of U.S. Pat. application Ser. No. 460,377, filed June 1, 1965, now U.S. Pat. No. 3,908,177, which is a continuation-in-part of U.S. Pat. application Ser. No. 403,002, filed Oct. 12, 1964, now abandoned.

BACKGROUND OF THE INVENTION

This invention relates in general to imaging, and more specifically, to an improved imaging system.

There has been recently developed a photoelectrosolographic imaging system capable of producing high quality images of high density, continuous tone, and high resolution. This system is described and claimed in the above mentioned copending application Ser. No. 403,002. In a typical embodiment of this imaging system, a photoelectrosolographic structure comprising a conducting substrate with a layer of softenable or soluble material, containing photosensitive particles overlying the conductive substrate is imaged in the following manner: An electrostatic latent image is formed on the photoconductive surface, e.g., by uniform electrostatic charging and exposure to a pattern of activating electromagnetic radiation. The softenable layer is then developed by exposing the plate to a solvent which dissolves only the soluble layer. The photoconductive particles which have been exposed to radiation migrate through the softenable layer as it is softened and dissolved, leaving an image on the conductive substrate conforming to a negative of the original. This is known as a positive to negative image. Through the use of various techniques, either positive to positive or positive to negative images may be made depending on the materials used and the charging polarities. Those portions of the photoconductive layer which do not migrate to the conductive substrate may be washed away by the solvent with the softenable layer.

In another recently developed imaging system, an image is formed by the selective disruption of a particulate material overlying an electrostatically deformable film or layer. The imaging structure used in this system is substantially the same as that used in a photoelectrosolographic imaging already described above, and involves exposing the charged member to an optical image to selectively relocate the charge and form a developable charge pattern. The softenable layer is then developed or softened by heat whereupon the particulate layer is selectively disrupted resulting in a rearrangement of the particles to form an image viewable by reflected or transmitted light. When the structure is developed by heat, the photoconductive area or layer is disrupted and the photoconductive particles are thereby selectively rearranged to change the optical properties of the plate. The image is believed to be formed because the photoconductive particles drift on top of one another and accumulate in valleys or pockets of the deformation image leaving the raised portions of the image uncovered. This imaging system is believed to be substantially due to a surface disruption effect with no substantial migration of the photoconductive particles within the softenable layer. This final image differs from that of photoelectrosolography described above, in that the softenable layer is deformed in conjunction with a disruption of the photoconductive particles. This system is described and claimed in copending application Ser. No. 520,423, filed on Jan. 13, 1966, now abandoned.

Another related imaging system is directed to the formation of a photoelectrosolographic image, and comprises exposing a photoelectrosolographic structure to a vapor to form a migration image, composed of photoconductive particles followed by heating said structure, whereby a high density image having a low background is produced. This system is described and claimed in copending application Ser. No. 612,122, filed on Jan. 27, 1967. If desired, the migration image formed above may be utilized as a separate image without resorting to the heating step.

In general, three basic migration imaging member structures may be used: a layered configuration which comprises a conductive substrate coated with a layer of softenable material, and an overcoating of photoconductive material (usually particulate) embedded at the upper surface of the softenable layer; a binder structure in which the photoconductive particles are dispersed throughout the softenable layer which overcoats a conducting substrate; and an overcoated structure in which a conductive substrate is overcoated with a layer of softenable material followed by an overcoating of photoconductive particles and a second overcoating of softenable material which sandwiches the photoconductive particles.

The photoelectrosolographic process comprises a combination of process steps which include charging, exposing, and developing with a solvent. The characteristics of these images are dependent on such process parameters as potential, exposure, and development time, as well as the particular combination of the process steps. High density, continuous tone and high resolution are some of the photographic characteristics possbile. The image is characterized as a fixed or unfixed photoconductivee powder image which can be used in a number of applications such as microfilm, hard copy, optical masks, and stripout applications using adhesive materials. Alternative embodiments of this concept are further described in the above cited copending applications.

In a related imaging system described in copending U.S. Pat. application Ser. No. 483,675, filed Aug. 30, 1965, now U.S. Pat. No. 3,909,963, non-photoconducting particulate material is used to form images in the photoelectrosolographic mode already defined above. In this system, a developable image is formed by charging in image configuration through the use of a mask or stencil. This image is then developed in a solvent for the softenable material.

Although each of the above imaging systems is capable of producing excellent images, the structure being imaged includes a conductive support member which functions as a ground plane during the development or migration of the photoconductive particles during the development step. The elimination of the conductive support would greatly simplify the manufacture of such structures and significantly reduce their cost.

SUMMARY OF THE INVENTION

It is, therefore, an object of this invention to provide an imaging system which overcomes the above noted disadvantages.

It is another object of this invention to provide an improved imaging structure.

It is a further object of this invention to provide an imaging structure having a dielectric support capable of producing high quality images.

It is yet another object of this invention to provide an improved imaging system.

The foregoing objects and others are accomplished in accordance with this invention by providing a novel migration imaging structure and imaging system which utilizes a conductorless support member and single polarity charging. This structure comprises an electrically insulating or conductorless support overcoated with a layer of softenable or soluble material containing photosensitive particles. The structure is charged to the same charge densities used for the previously mentioned structures defined in the above copending applications having a conducting support. However, since the capacitance of the structure with the insulating support is much lower than that of the structure with the conducting support, these charge densities are accompanied by proportionally higher electrostatic potentials. Thus the potentials required for the structure with the insulating support are proportionally multiplied over those for the structure with a conducting support by an amount equal to the capacitance of the layer of soluble material alone divided by the combined capacitance of the insulating support and the layer of soluble material. With this in mind, the structure of this invention is charged to a relatively high potential such as from about 1,000 to 5,000 volts with a standard corotron or equivalent means, while being placed on a conductive ground plate. After charging, the structure is exposed under dark room conditions to a pattern of activating electromagnetic radiation to form a latent image, and then developed for a few seconds in a solvent liquid or vapor to cause selective movement of the photoconductive particles in the areas which have been exposed to radiation down to or near the conductorless substrate. The resulting images are comparable to those obtained with structures having a conductive layer between the conductorless base and soluble layer which are defined in the above mentioned copending applications Ser. Nos. 460,377; 403,002; 483,675; 520,423; and 612,122. This method is adaptable to migration imaging structures employing both organic and inorganic photoconductors, or non-photoconducting particulate material where the latent image is formed by charging directly in image configuration such as through the use of a mask or stencil. This method results in the formation of images having resolutions of 150 to 228 line pairs per millimeter.

BRIEF DESCRIPTION OF THE DRAWINGS

The advantages of this improved system will become apparent upon consideration of the following disclosure of the invention; especially when taken in conjunction with the accompanying drawings wherein:

FIG. 1 illustrates a typical imaging structure of this invention comprising an imaging plate 10 having a conductorless or dielectric substrate 11, having a softenable layer 12 overlying the conductorless layer, and a photoconductive material 13 usually in particulate form, contained in the softenable layer 12. The dielectric base 11 may comprise any suitable material which is substantially insoluble or unaffected by a solvent for softenable layer 12. Typical materials include polytetrafluoroethylene and polyester resins such as polyethylene terephthalate; polyamide films such as those prepared from caprolactam Nylon 66, films prepared from polyacrylonitrile and copolymers thereof, mica glass, and other insulating materials generally known in the art.

Figure 1:
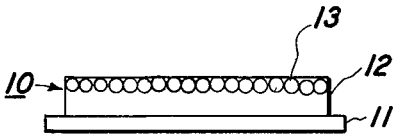
FIG. 1 is a schematic illustration of one embodiment of the imaging plate.
Figure 2:
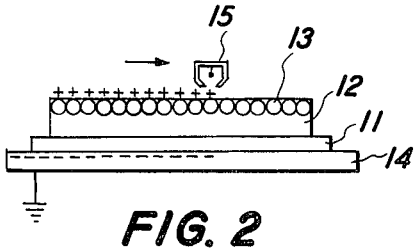
FIG. 2 is a schematic illustration of an imaging plate during the charging step.
Figure 3:
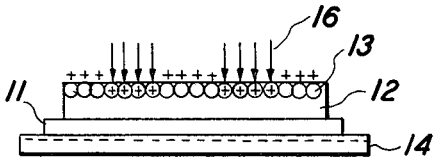
FIG. 3 is a schematic illustration of the plate of FIG. 2 during the exposure step.
Figure 5:
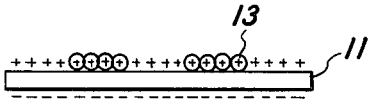
FIG. 5 shows the developed plate.

The structure of FIG. 1 is then placed on an electrically conductive ground plate 14, as shown in FIG. 2, and uniformly charged over its entire surface such as with a corona charging device 15. The ground plate 14 may comprise any suitable electrical conductor such as copper, brass, aluminum, steel, silver, gold, conductively coated glass, plastic or paper or the like. It is not necessary that the imaging structure contact the ground plane by any means other than by gravity and the coulomb forces which occur during charging. The ground plane, in effect, provides a source of mobile charges of both polarities. The use of this ground plane permits the acceptance of a reusable sensitizing charging, and at the same time permits migration of the charges under the applied field when exposed to activating radiation. The charged element contained on the ground plate 14 is then exposed to activating radiation 16 as illustrated in FIG. 3. The imaging plate is then stripped away from the ground plate and developed in a solvent liquid 18 contained in container 17, which washes away the softenable layer 12, while leaving substantially intact the photoconductive particles 13 which have been exposed to radiation and have selectively migrated to the dielectric substrate in image configuration, as shown in FIG. 5. The photoconductive particles 13 are apparently held by surface forces and/or electrostatic forces and tenaciously resist being washed away by the solvent. During development, the dielectric substrate 11 receives the charge originally deposited on the imaging plate 10 by the corona charging device 15. However, in some developing solvent liquids 18, this charge is neutralized so that little or no potentials can be measured on the dielectric substrate 11.

The softenable plastic layer 12 may be any suitable material which is softened in a vapor solvent, or heat, and in addition, is substantially electrically insulating during the imaging and developing cycle. Typical materials are Staybelite Ester 10, a partially hydrogenated rosin ester, Foral Ester, a hydrogenated rosin triester, and Neolyne 23, an alkyd resin, all from Hercules Powder Co., SR 82, SR 84, silicone resins, both obtained from General Electric Corporation; Sucrose Benzoate, Eastman Chemical; Velsicol X-37, a polystyrene-olefin copolymer from Velsicol Chemical Corp.; Hydrogenated Piccopale 100, a highly branched polyolefin, Piccotex 100, polystyrene-vinyl toluene, Piccolastic A-75, 100 and 125, all polystyrenes, Piccodiene 2215, a polystyrene-olefin copolymer, all from Pennsylvania Industrial Chemical Co.; Araldite 6060 and 6071, epoxy resins of Ciba; R5061A, a phenylmethyl silicone resin, from Dow Corning; Epon 1001, a bisphenol A-epichlohydrin epoxy resin, from Shell Chemical Corp.; and PS-2, PS-3, both polystyrenes, and ET-693, a phenol-formaldehyde resin, from Dow Chemical; and 96-A, a custom synthesized copolymer of styrene and hexylmethacrylate.

The above group of materials is not intended to be limiting, but merely illustrative of materials suitable for the softenable plastic layer. The softenable layer may be of any suitable thickness, with thicker layers generally requiring a greater potential for charging. In general, a thickness from about 1 to 4 microns has been found satisfactory.

The material comprising layer 13 may consist of any suitable inorganic or organic photoconductive material. The photoconductive material is usually submicron is size, and in particulate form which includes a fracturable or microscopically discontinuous layer or dispersion. Typical inorganic photoconductors are vitreous selenium, vitreous selenium alloyed with arsenic, tellurium antimony or bismuth, etc.; cadmium sulfide, zinc oxide, cadmium sulfoselenide, and many others. U.S. Pat. 3,121,006 to Middleton et al admirably sets forth a whole host of typical inorganic photoconductive pigments. Typical organic photoconductors are: Watchung Red B, a barium salt of 1-(4'-methyl-5'-chloro-azobenzene-2'-sulfonic acid)-2-hydrohydroxy-3-napthoic acid, C.I. No. 15865, available from duPont; Indofast double scarlet toner, a Pyranthrone-type pigment available from Harmon Colors; quindo magenta RV-6803, a quinacridone-type pigment available from Harmon Colors; Cyan Blue, GTNF the beta form of copper phthalocyanine, C.I. No. 74160 available from Collway Colors; Monolite Fast Blue GS, the alpha form of metal-free phthalocyanine, C.I. No. 74100, available from Arnold Hoffman Co.; Diane Blue, 3,3'-methoxy-4,4'-dipheny-bis(1''azo-2''hydroxy-3''-naphthanilide), C.I. No. 21180, available from Harmon Colors and Algol G.C., 1,2,5,6-di(D,D'-diphenyl)-thiazoleanthraquinone, C.I. No. 67300, available from General Dyestuffs. The above list of organic and inorganic photoconductors is illustrative of some of the typical photoconductive materials, and should not be taken as a complete listing of photoconductive materials.

The developer solvent 18, may consist of any suitable liquid or vapor in which the layer 12 dissolves or is softened while leaving uneffected on or near the supporting substrate, the photoconductor material in the form of the original image. The only requirement of the solvent is that it be a solvent for the softenable layer only, and that it be substantially electrically insulating in the sense that the charged image is not discharged electrically be exposure to the solvent. The time of exposure to the solvent is in no way critical, inasmuch as the substrate and photoconductive material are selected so as to be substantially insoluble during development. In general, a few seconds of immersion in the solvent is more than sufficient to soften and/or dissolve the softenable plastic. Typical solvents are Freon TMC, available from duPont; trichloroethylene, chloroform, ethyl ether, xylene, dioxane, benzene, toluene, cyclohexane, 1,1,1-trichloroethylene, pentane, n-heptane, Odorless Solvent 3440 (Sohio), Freon 113, available from duPont; m-xylene, carbon tetrachloride, thiophene, diphenyl ether, p-cymene, cis-2,2-dichloroethylene, nitromethane, N,N-dimethyl formide, ethanol, ethyl acetate, methyl ethyl ketone, ethylene dichloride, methylene chloride, 1,1-dichloroethylene, trans 1,2-dichloroethylene, and super naptholite (Buffalo Solvents and Chemicals).

In an alternative embodiment of this invention, the ground plane may be kept attached to the imaging structure 10, and development carried out with the ground plane and imaging plate 10 in contact, with the subsequent stripping of the dielectric layer from the ground plate occurring after development. In certain instances it may also be desirable to include a conducting layer underneath the insulating support. This layer would provide better electrical ground contact to the insulating support and can be removed during or after development. For example, it could be removed as a result of development, and need not be transparent.

In another embodiment of this invention, the ground plate may be replaced with a second charging unit. For example, a pair of corona charging devices such as described in U.S. Pat. No. 2,777,957 may be simultaneously passed over the upper and lower surface of the imaging plate. This results, for example, in a simultaneous deposition of positive charges on the photoconductive exposed surface, and negative charge on the bottom or underside of the structure 10 which will create a virtual ground plane within the body of inmaging plate 10. This is equivalent to placing opposite charges or charges of an opposite polarity through the use of an actual ground plane.

Figure 4:
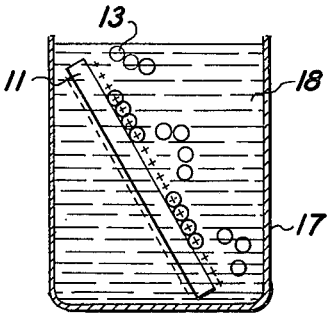
FIG. 4 is a schematic illustration of the imaging plate of FIG. 3 during a development step.

It should be noted that the development step as illustrated in FIG. 4 may be carried out by the means of a solvent liquid, solvent vapor, heat, or the combination of vapor plus heat or heat plus vapor plus heat. These methods of development have been adequately set forth in the above mentioned copending applications.

Generally, when using a single polarity charging with a grounded plane, an applied electrostatic voltage from about 1000 to 5000 volts is usually satisfactory. Voltages outside this range, however, may also be used.

In addition to the configuration shown in FIG. 1, additional modifications of the basic structure such as the use of the binder form in which the structure consists of photoconductive particles dispersed throughout the soluble layer, may also be used. In addition an overcoated structure in which the photoconductive particles are sandwiched between two layers of the softenable material which overlies the dielectric support substrate.

The particulate layer for the layered configuration of FIG. 1 may be formed by any suitable method. Typical methods include vacuum evaporation such as disclosed in patent application Ser. No. 423,167, filed jan. 4, 1965, now abandoned, where a particulate layer of submicron size vitreous selenium is formed on a softenable layer. The articulate layer may be formed by other methods such as by cascading, dustng, etc., as shown in copending U.S. Patent application Ser. No. 460,377, filed June 1, 1965. The thickness of the particulate layer is usually less than about 1 micron in thickness but may be as thick as 8 to 10 microns if desired. When a binder structure is used, the method set forth in U.S. Pat. No. 3,121,006 may be used to form the binder structure.

The uniform electrostatic charging step as shown in FIG. 2 is accomplished by means of a corona charging head 15 which scans the upper surface of the imaging plate and deposits a uniform charge on the surface of the photoconductive layer as it passes over its surface. Typical corona charging methods and devices are described in Walkup U.S. Pat. No. 2,777,957. Other methods of forming an electrostatic image on the imaging plate are also included within the scope of this invention. Typical methods include directly forming a electrostatic latent image by corona charging through a stencil as shown in copending application Ser. No. 483,675, filed Aug. 30, 1965, or forming a latent image directly through the use of a shaped electrode or pin matrix.

In another embodiment of this invention a photoconductor material 13 may be replaced with a non-photoconductive material. This material is also in particulate form (usually submicron in size) and may be electrically conductive or insulating. Typical materials are carbon black, garnite, iron oxide and insoluble dyes. With exception of utilizing a non-photoconductive material, and charging through a master stencil or using a shaped electrode, etc.; the method and materials used are essentially the same as those shown and described with respect to the use of the photoconductive materials described above.

The following examples specifically define the present invention with respect to a method of imaging a conductorless element. The parts and percentages in the disclosure, examples, and claims are by weight unless otherwise indicated. The examples are intended to illustrate the various preferred embodiments of the developing technique for utilizing a conductorless imaging plate.

EXAMPLE I

An imaging plate such as that illustrated in FIG. 1 is prepared by roll-coating a two micron layer of Staybelite Ester 10 (Hercules Powder Company) on a 3 mil Mylar polyester film (E. I. duPont de Nemours & Co., Inc.). A thin layer of vitreous selenium, approximately one micron in thickness, is then deposited onto the Staybelite by inert gas desposition using the process set forth in copending patent application Ser. No. 423,167, filed on Jan. 4, 1965. The plate is then placed on a copper ground plate and electrostatically charged under dark room conditions to a positive potential of about 2500 volts by means of a corona discharge device described by Carlson in U.S. Pat. No. 2,588,699. The charged plate is then exposed to an optical image with an energy in the illuminated areas of about 10 foot-candle-seconds by means of a tungsten lamp and a weak blue filter. The plate is then stripped off the ground plate and developed by immersing it in a bath of cyclohexane for about 2 seconds. The plate is removed from the developer bath and dried. An excellent image corresponding to the projected image is observed on the plate. This image comprises a thin layer of selenium particles in image configuration on a copper substrate.

EXAMPLE II

A plate prepared by the method of Example I in which Piccotex 100 (Pennsylvania Industrial Chemical Co.), substituted in place of the Staybelite, is imaged as follows. The plate is placed on a copper ground plate and electrostatically charged under dark room conditions to a positive potential of 4500 volts by means of a corona discharge device. The plate is then exposed to an optical image of 3 foot-candle-seconds of tungsten light. The exposed plate is heated to 100°C. for about 10 seconds whereby a negative image is produced by the disruption of the selenium layer and rearrangement of particles at the light-struck areas of the plate.

EXAMPLE III

The process of Example II is carried out except that the selenium is vacuum evaporated onto a layer of Staybelite 10 (a glyceryl ester of hydrogenated rosin) instead of Piccotex 100 resin, the plate is charged to a positive potential of about 4800 volts; exposure is 6 foot-candle-seconds. Again, a negative image results.

EXAMPLE IV

A plate is made by first roll-coating a sheet of Mylar polyester film (E. I. duPont de Nemours Co., Inc.) with a layer of Piccotex 100 (Pennsylvania Industrial Chemical Company) approximately 2 microns in thickness. A mixture of air spun graphite particles (Type 200-19, The Joseph Dixon Crucible Co., Jersey City, N.J.) and 50 micron glass beads is then cascaded across the surface of the resin layer to form a layer 13 (FIG. 1) approximately 1 micron in thickness.

The plate is placed on a copper ground plate and an electrostatic image is formed on the plate by means of charging with corona discharge device through a stencil. The image areas are positively charged to a potential of about 2500 volts. The latent image-bearing plate is then treated with cyclohexane vapor resulting in migration of the charted areas of layer 13 to the surface of the polyester film. Non-imaged portions of layer 13 and the layer of Piccotex 100 are then removed by immersing the developed plate in liquid cyclohexane for about 10 seconds. The result is a faithful visible replica of the electrostatic image.

EXAMPLE V

An imaging plate or film such as that illustrated in FIG. 1 is prepared by first making a mixture of 5% by weight of Staybelite Ester 10 (a 50% hydrogenated glycerol rosin ester of the Hercules Powder Co.), dissolved in a solution of 20% cyclohexanone and 75% toluene. Using a gravure roller, the mixture is then roll coated onto a 3 mil Mylar polyester film (E. I. duPont de Nemours Co., Inc.). The coating is applied so that when air dried for about 2 hours to allow for evaporation of the cyclohexanone and toluene solvent, an imaging plate comprising a two micron layer of Staybelite Ester is formed on the Mylar. A thin layer of particulate vitreous selenium approximately 0.5 microns in thickness is then deposited onto the Staybelite surface by inert gas deposition utilizing the process set forth in copending patent application Ser. No. 423,167, filed on Jan. 4, 1965, now abandoned.

EXAMPLE VI

An imaging plate or film is formed by the method of Example V in which the Staybelite Ester is replaced with a 5% mixture of 96-A, a copolymer of styrene and hexylmethacrylate, dissolved in toluene. The resultant plate comprises a thin particulate vitreous selenium layer approximately 0.5 microns in thickness deposited in the upper surface of the plastic which is contained on a 3 mil Mylar substrate.

EXAMPLE VII

An imaging plate or film is made according to the method set forth in Example V in which the Staybelite Ester is replaced with a 5% mixture of HP-100, a highly branched polyolefin, dissolved in toluene, with the final plate comprising a thin layer, 0.5 microns thick, of particulate vitreous selenium contained in the upper surface of the HP-100 on aluminized Mylar.

EXAMPLE VIII

A sample of the film produced in Example V is imaged and developed in the following manner. The film is placed over a copper ground plate and charged under dark room conditions to a positive potential of 4200 volts through the use of a corona charging device such as that set forth in U.S. Pat. No. 2,588,699 to Carlson. The film is then exposed to an optical image with the energy in the illuminated areas of about 5 foot-candle-seconds by means of a tungsten lamp. The film is kept on the ground plate and then developed, while still maintaining dark room conditions, by immersing in vapors of 1,1,1-trichloroethylene for about 3 seconds.

The vapor developed film is then heated by placing the film for about 3 seconds on a hot plate maintained at a temperature of about 90°. At the end of this heating step the film is then stripped from the copper ground. When viewed in a conventional slide projector, the film exhibits a reduced background density near zero, with an image density of about 0.9+. When viewed under a microscope, the selenium particles in the previously unexposed areas have been found to agglomerate and fuse due to the heating, and form relatively large spheres. The photoconductive particles in the previously light exposed areas, which have migrated in image configuration during the vapor development, appear to remain substantially uneffected by the heating.

EXAMPLES IX–X

The films of Examples VI and VII are imaged according to the method of Example VIII using a positive potential of about 8000 volts and a developer comprising vapors of a 50% mixture of Freon 113 and methylene chloride. Both of the samples show high quality images having substantially zero background.

EXAMPLE XI

A sample of the film produced in Example V is imaged and developed as follows. The film is placed over a copper ground plate and charged under dark room conditions to a positive potential of about 3000 volts by a corona charging device such as that shown in U.S. Pat. No. 2,588,699 to Carlson. The film is then exposed to about 10 foot-candle-seconds of light from a tungsten light source. While still maintaining dark room conditions, the film is vapor developed using the technique in Example IV except that two separate exposures to vapor are used. The film is first exposed to vapors of Freon 113 for about 2 seconds causing a migration of photoconductive particles in the light struck areas. With the room lights on, the film is then exposed to 1,1,1-trichloroethylene vapors for about 3 seconds. The film is then placed on a hot plate and heated for about 2 seconds at 95°C. When viewed in a slide projector this film exhibits substantially no background due to the agglomeration and fusion of the photoconductor particles caused by the heat in the areas which have not been struck by radiation. In Examples VIII–XI, a visible migration image consisting of photoconductive particles near the insulating substrate in the exposed areas and at the upper surface of the soluble plastic layer in the unexposed areas is formed as a result of development by solvent vapors. This migration image is improved optically by the heating step following the vapor development.

Although specific components and proportions have been stated in the above description of the preferred embodiments of this invention, other suitable materials and procedures such as those listed above, may be used with similar results. In addition, other materials and changes may be utilized which synergize, enhance, or otherwise modify the Applicant's novel process.

Other modifications and ramifications of the present invention would appear to those skilled in the art upon reading the disclosure. These are intended to be within the scope of this invention.

What is claimed is:

1. An imaging method comprising:

providing an imaging member comprising a dielectric substrate, an overlayer of substantially electrically insulating softenable material and a fracturable layer of particulate material embedded at the surface of the softenable overlayer spaced apart from the substrate, said softenable material capable of having its resistance to migration of said particulate material decreased sufficiently to allow migration of the particulate material through the softenable material toward said substrate, placing the dielectric substrate of said member in contact with an electrical ground, forming an electrostatic latent image on said member, developing said imaging member after the forming of the electrostatic latent image by decreasing the resistance of the softenable material to migration of the particulate material at least sufficient to allow migration of the particulate material through the softenable material whereby selected portions of the particulate material migrate in image configuration toward said substrate.

2. The method of claim 1 wherein development is performed by contacting the imaging member with a liquid solvent capable of at least softening said softenable material.

3. The method of claim 1 wherein development is performed by contacting the imaging member with a solvent vapor capable of at least softening said softenable material.

4. The method of claim 1 wherein development is carried out by heating the imaging member in an amount sufficient to soften the softenable material to allow migration of the particulate material.

5. The method of claim 1 wherein development is carried out by contacting the imaging member with solvent vapors followed by heating the imaging member both the solvent vapors and heating combined being sufficient to soften said softenable material to allow migration of the particulate material.

6. The method of claim 1 wherein the imaging member is removed from the electrical ground prior to development.

7. The method of claim 1 wherein said particulate material comprises photoconductive material.

8. The method of claim 7 wherein the particulate material comprises selenium.

9. The method of claim 7 wherein the electrostatic latent image is formed by uniformly electrostatically charging the imaging member, and selectively exposing the imaging member to an image pattern of activating electromagnetic radiation.

10. An imaging method comprising:

providing an imaging member comprising a dielectric substrate, an overlayer of substantially electrically insulating softenable material and a fracturable layer of particulate material embedded at the surface of the softenable overlayer spaced apart from the substrate, said softenable material capable of having its resistance to migration of said particulate material decreased sufficiently to allow migration of the particulate material through the softenable material toward said substrate, forming an electrostatic latent image on said imaging member by steps including electrostatically charging the substrate surface of said imaging member with electrical charges of opposite polarity to the electrical charges comprising said electrostatic latent image on the non-substrate surface of said imaging member; and developing said imaging member after the formation of the electrostatic latent image by decreasing the resistance of the softenable material to migration of the particulate material at least sufficient to allow migration of the particulate material through the softenable material whereby selected portions of the particulate material migrate in image configuration toward said substrate.

11. The method of claim 10 wherein development is performed by contacting the imaging member with a liquid solvent capable of at least softening said softenable material.

12. The method of claim 10 wherein development is performed by contacting the imaging member with a solvent vapor capable of at least softening said softenable material.

13. The method of claim 10 wherein development is carried out by heating the imaging member in an amount sufficient to soften the softenable material to allow migration of the particulate material.

14. The method of claim 10 wherein development is carried out by contacting the imaging member with solvent vapors followed by heating the imaging member both the solvent vapors and heating combined being sufficient to soften said softenable material to allow migration of the particulate material.

15. The method of claim 10 wherein the particulate material comprises photoconductive material.

16. The method of claim 15 wherein the particulate material comprises selenium.

17. The method of claim 15 wherein the electrostatic latent image is formed by uniformly electrostatically charging the imaging member, and selectively imagewise exposing the imaging member to an image pattern of activating electromagnetic radiation.

* * * * *